US007256537B2

(12) United States Patent
Fu

(10) Patent No.: US 7,256,537 B2
(45) Date of Patent: Aug. 14, 2007

(54) LUMINOUS DISPLAY WITH TROUGH MEMBER AND METHOD OF MAKING SAME

(76) Inventor: Hing Hung Ricky Fu, Block F, 8/F., Sun View Industrial Building, 3 On Yip Street, Chai Wan, Hong Kong (CN)

( * ) Notice: Subject to any disclaimer, the term of this patent is extended or adjusted under 35 U.S.C. 154(b) by 386 days.

(21) Appl. No.: 10/837,577

(22) Filed: May 4, 2004

(65) Prior Publication Data

US 2005/0248254 A1 Nov. 10, 2005

(51) Int. Cl.
*H01J 1/62* (2006.01)
*H01J 63/04* (2006.01)

(52) U.S. Cl. ..... 313/484; 313/485; 313/493; 313/634

(58) Field of Classification Search ..... 313/484–485, 313/493, 607, 609, 634, 514; 362/364, 263
See application file for complete search history.

(56) References Cited

U.S. PATENT DOCUMENTS 4,403,831 A 9/1983 Amano
5,126,632 A 6/1992 Parker
5,281,898 A 1/1994 Albright
5,383,295 A 1/1995 Strattman
5,444,331 A * 8/1995 Matsuno et al. ..... 313/553
6,512,331 B1 1/2003 Fu

* cited by examiner

*Primary Examiner*—Sikha Roy
*Assistant Examiner*—Kevin Quarterman
(74) *Attorney, Agent, or Firm*—Buchanan Ingersoll & Rooney PC

(57) ABSTRACT

A luminous display device is disclosed as including a transparent or translucent top body part having a rear surface; a bottom body part having a front side, a rear side, and a trough extending along at least part of the front side of the bottom body part to form a pre-defined pattern; in which the rear surface of the upper body part is in fused sealing relationship with the front side of the bottom body part to form a sealed discharge chamber between the trough and the upper body part; an ionizable gas filling the chamber; and two openings in the bottom body part each having a first end communicating with the chamber and a second end communicating with an electrode, the electrodes being energizable to ionize the gas in the chamber to produce light discharge of the pre-defined pattern.

11 Claims, 4 Drawing Sheets

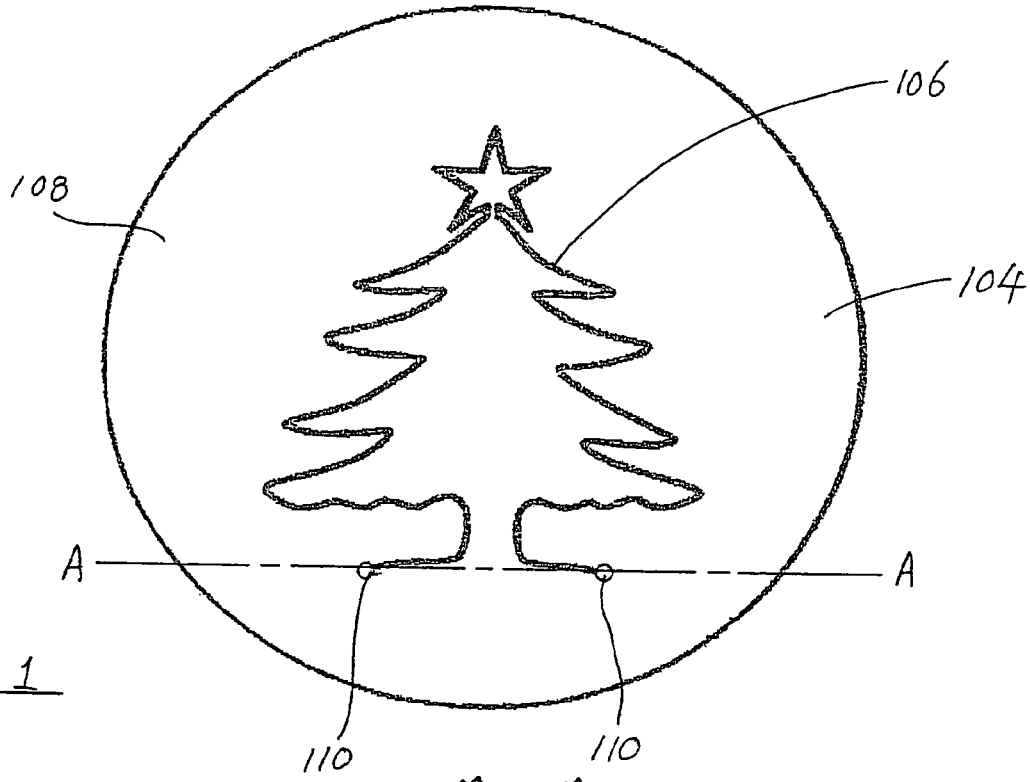
Fig. 1
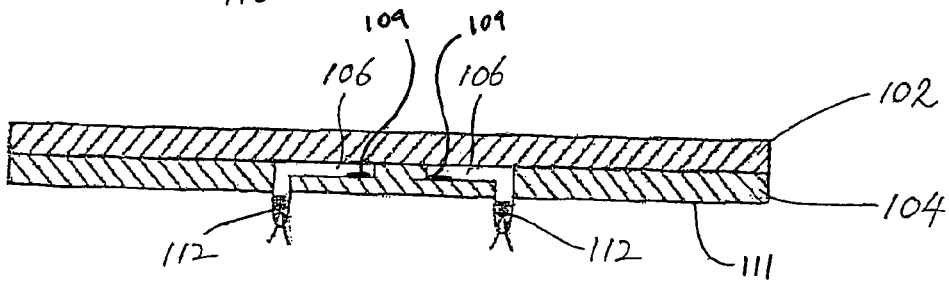
Fig. 2
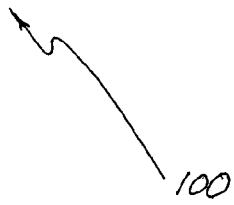

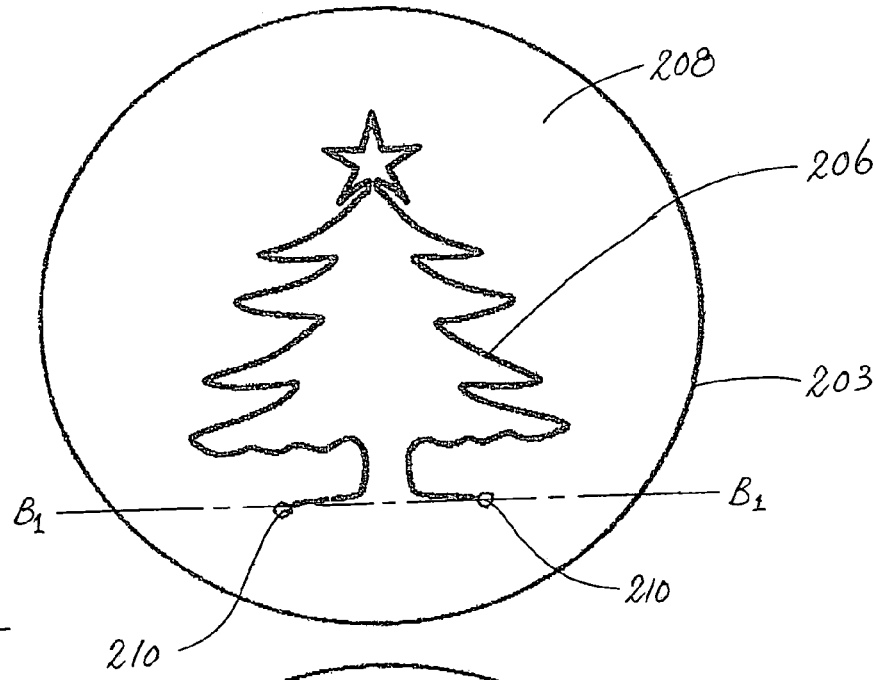
Fig. 3
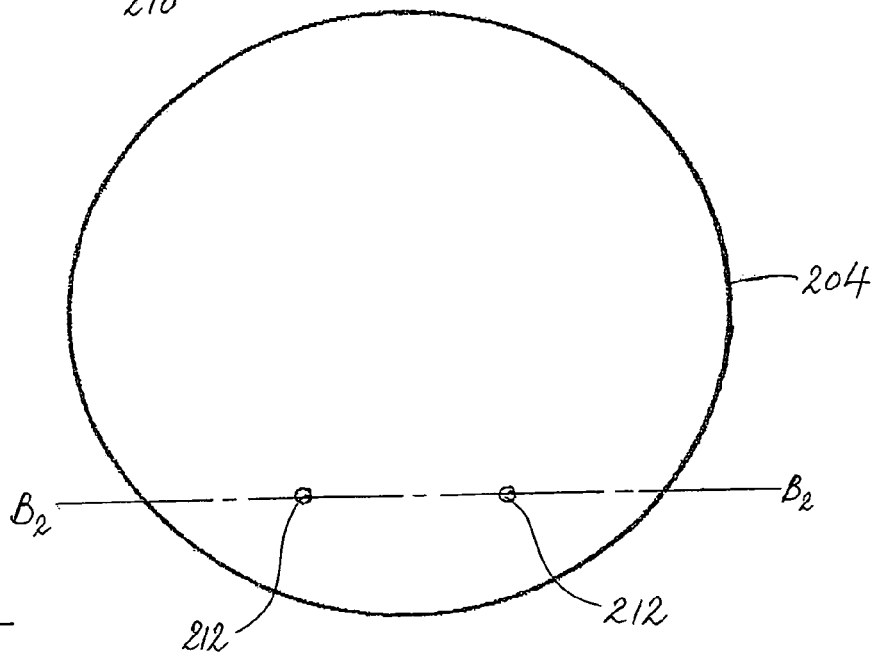
Fig. 4
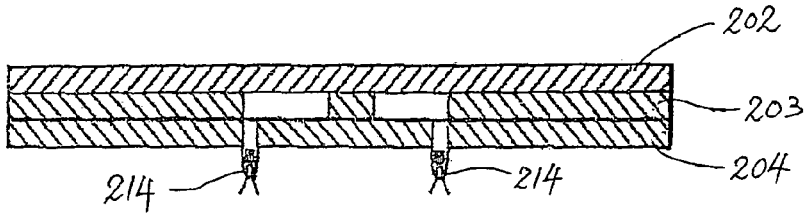
Fig. 5
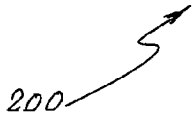

LUMINOUS DISPLAY WITH TROUGH MEMBER AND METHOD OF MAKING SAME

This invention relates generally to luminescent display devices and to a method of manufacturing same. More particularly, the invention relates to gas plasma display devices.

BACKGROUND OF THE INVENTION

It is well known to produce light by passage of electricity through gases. This phenomenon has been used in lighted signs which display numerals, characters, symbols, graphics and the like, such as neon signs for example. Gases commonly used for this purpose are neon, argon, mercury vapour, or mixtures thereof.

U.S. Pat. Nos. 5,383,295, 5,126,632, 5,281,898 and 4,403,831 disclose various conventional display devices. U.S. Pat. No. 6,512,331 issued to the applicant herein discloses a luminous display device and a method of making the same in which a front member of transparent glass is fused to the rim area of a rear member having a recess therein and protuberances projecting from the base of the recess toward the front member. The protuberances are closely spaced with respect to each other and the front member to provide passages between the protuberances and a light discharge member between the front member and the recess. An opening extends through the rear member communicating with the chamber. A tubular member mounted on the rear member communicates with the opening for evacuating the chamber and filling it with an ionizable gas. An electrode device is mounted in the tubular member and is operatively connected to a power source for ionizing the gas in the chamber thereby producing light discharge fingers or streaks through the passages providing the desired display of light. The rear member is moulded to form the recess and protuberances integral therewith thus minimizing the number of parts of the display device. The content of U.S. Pat. No. 6,512,331 is fully incorporated herein by reference.

As the closely spaced protuberances in the device in U.S. Pat. No. 6,512,331 do not provide a pre-defined passage(s) along which the light discharge fingers or streaks are produced, but intersticial passages along which the light discharge fingers or streaks may be produced, neither the manufacturer nor the user can determine the light patterns produced by such a display, and in fact the light patterns generated by such a display are random and always differ.

It is thus an object of the present invention to provide a luminous display device and a method of manufacturing same in which the aforesaid shortcoming is mitigated, or at least to provide a useful alternative to the public.

It is a further object of the present invention to provide a luminous display in which pre-defined light pattern(s) can be produced upon activation of the display.

SUMMARY OF THE INVENTION

According to a first aspect of the present invention, there is provided a luminous display device comprising a non-opaque first member having a rear surface; a second member having a front side, a rear side, and at least a first trough member extending along at least part of said front side of said second member to form at least a first pre-defined pattern; wherein said rear surface of said first member is in fused sealing relationship with said front side of said second member to thereby form at least a first sealed discharge chamber between said first trough member and said first member; an ionizable gas filling said chamber; and at least a first opening in one of said first and second members having a first end communicating with said first chamber and a second end communicating with an electrode means, said electrode means being energizable to ionize said gas in said first chamber to produce light discharge of said at least first pre-defined pattern.

According to a second aspect of the present invention, there is provided a method of making a luminous display device, comprising the steps of providing a non-opaque first member having a rear surface; moulding a second member with a front side, a rear side, and at least a first trough member extending along at least part of said front side of said second member to form at least a first pre-defined pattern; fusing said rear surface of said first member with said front side of said second member to form at least a first sealed discharge chamber between said first trough member and said first member; producing at least a first opening in one of said first and second members having a first end communicating with said first chamber; evacuating said first chamber through said first opening; filling said first chamber through said first opening with an ionizable gas; and installing electrode means in communication relationship with a second end of said first opening, wherein said electrode means is energizable to ionize said gas in said first chamber to produce light discharge of said at least first pre-defined pattern.

BRIEF DESCRIPTION OF THE DRAWINGS

Preferred embodiments of the present invention will now be described, by way of examples of only, with reference to the accompanying drawings, in which:

FIG. 1 is a top view of a bottom body part forming part of a luminous display according to a first embodiment of the present invention;

FIG. 2 is a sectional view of a luminous display according to the first embodiment of the present invention, taken along the line A-A of FIG. 1;

FIG. 3 is a top view of a bottom body part forming part of a luminous display according to a second embodiment of the present invention;

FIG. 4 is a top view of an intermediate body part forming part of a luminous display according to a second embodiment of the present invention;

FIG. 5 is a sectional view of a luminous display according to the second embodiment of the present invention, taken along the line $B_1$-$B_1$ of FIG. 3, which coincides with line $B_2$-$B_2$ of FIG. 4;

DESCRIPTION OF THE PREFERRED EMBODIMENTS

Figure 6:
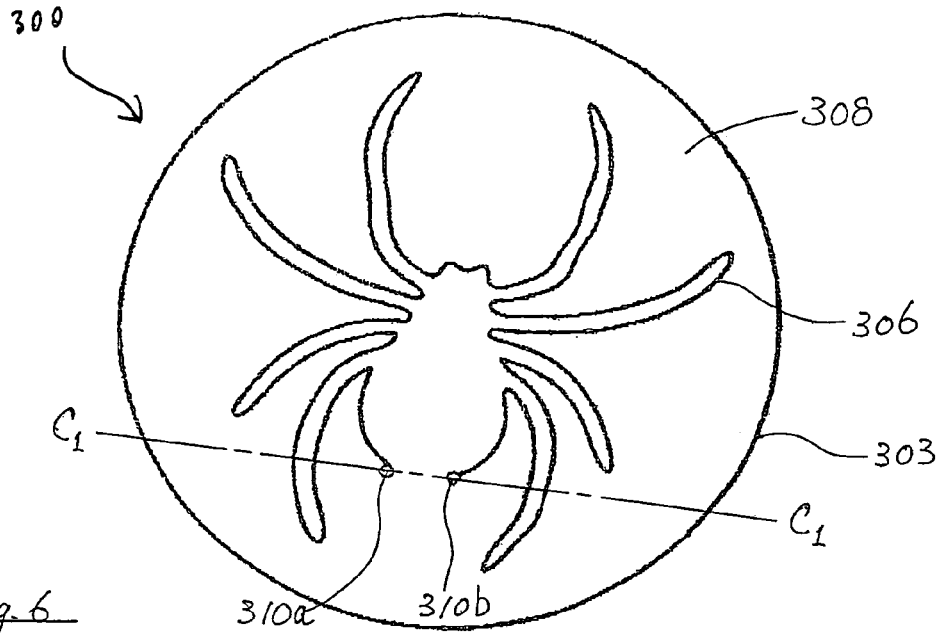
FIG. 6 is a top view of an intermediate body part forming part of a luminous display according to a third embodiment of the present invention.

In a first embodiment according to the invention, as shown in FIGS. 1 and 2, a luminous display 100 includes a top body part 102 and a bottom body part 104. The top body part 102 is made of a non-opaque, e.g. transparent or translucent, material, e.g. glass or plastics. The top body part 102 has substantially flat upper and lower surfaces. As to the bottom body part 104, and as shown in more detail in FIG. 1, a continuous recess 106 is formed, e.g. during the moulding stage, on an upper surface 108 of the bottom body part 104 to form a pre-defined pattern, e.g. a Christmas tree as now shown in FIG. 1. It should of course be understood that various other patterns can be formed. At each of two extremities of the recess 106 is an exhaust hole 110, leading to a lower surface 111 of the bottom body part 104.

During assembly of the luminous display 100, the lower surface of the top body part 102 is fused together with the upper surface 108 of the bottom body part 104 to form a chamber between the recess 106 and the lower surface of the top body part 102, leading on each side to one of the two exhaust holes 110. Air in the chamber is then evacuated through one or both of the exhaust holes 110. The chamber is then filled, again through one or both of the exhaust holes 110, with an ionizable gas, e.g. neon, argon, mercury vapour, or mixtures thereof. An electrode 112 is then installed at and in communication with a respective exhaust holes 110. The chamber formed between the recess 106 of the bottom body part 104 and the upper body part 102 is thus sealed. When the electrodes 112, which are connected to an electrical power source, are energized to ionize the gas in the chamber, a coloured light discharge in the shape of the pre-defined pattern will be generated. When the device is assembled, the recess 106 that is filled with ionized gas and energized, operates as a discharge chamber. That is, it should be understood that once the device is assembled, the recess area 106 also serves as a discharge chamber.

The colour of the light discharge will depend in part on the ionizable gas filled in the chamber. Different types of phosphor coatings 109 may also be applied on different parts of the recess 106 so that different colours will be shown upon ionization of the gas. Pre-defined multi-colour patterns may thus be generated upon ionization of the gas.

In a second embodiment according to the invention, as shown in FIGS. 3 to 5, a luminous display 200 includes a top body part 202, an intermediate body part 203 and a bottom body part 204. As in the case of the luminous display 100 discussed above, the top body part 202 is made of a non-opaque material, and has substantially flat upper and lower surfaces. As to the intermediate body part 203, and as shown in more detail in FIG. 3, a continuous recess 206 is formed, e.g. during the moulding stage, on an upper surface 208 of the intermediate body part 203 to form a pre-defined pattern, e.g. a Christmas tree as now shown in FIG. 3. At each of two extremities of the recess 206 is an opening 210, leading to a lower surface of the intermediate body part 203. As to the bottom body part 204, two through holes 212 are provided.

During assembly of the luminous display 200, the lower surface of the top body part 202 is fused together with the upper surface 208 of the intermediate body part 203. The lower surface of the intermediate body part 203 is then fused together with the upper surface of bottom body part 204, with the through holes 212 in communication with the openings 210, so as to form a chamber, leading on each side to a respective through hole 212. Air in the chamber is then evacuated through one or both of the through holes 212. The chamber is then filled, again through one or both of the through holes 212, with an ionizable gas. An electrode 214 is then installed at and in communication with a respective through hole 212. The chamber formed between the recess 206 of the intermediate body part 203, the upper body part 202 and the upper surface of the bottom body part 204 is thus sealed. When the electrodes 214 are energized to ionize the gas in the chamber, a coloured light discharge in the shape of the pre-defined pattern will be generated.

Figure 7:
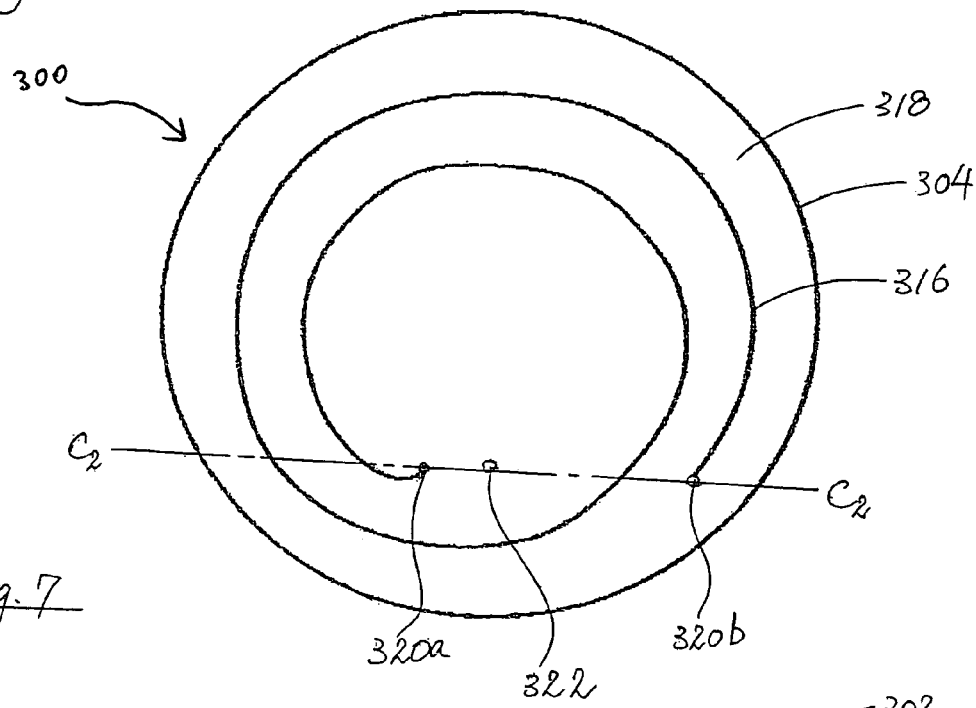
FIG. 7 is a top view of a bottom body part forming part of a luminous display according to a third embodiment of the present invention.
Figure 8:
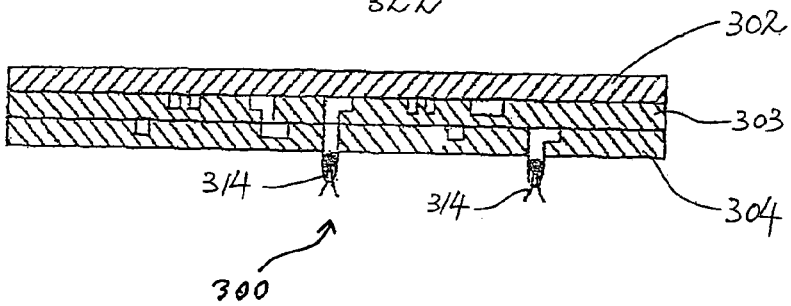
FIG. 8 is a sectional view of a luminous display according to the third embodiment of the present invention, taken along the line $C_1$-$C_1$ of FIG. 6, which coincides with line $C_2$-$C_2$ of FIG. 7.

In a third embodiment according to the invention, as shown in FIGS. 6 to 8, a luminous display 300 includes a top body part 302, an intermediate body part 303 and a bottom body part 304. The top body part 302 is made of a non-opaque material, and has substantially flat upper and lower surfaces. As shown in more detail in FIG. 6, a continuous recess 306 is formed, e.g. during the moulding stage, on an upper surface 308 of the intermediate body part 303 to form a first pattern, e.g. a spider. At each of two extremities of the recess 306 is a through hole 310*a*, 310*b*. As to the bottom body part 304, and as shown in FIG. 7, a continuous recess 316 is formed, e.g. during the moulding stage, on an upper surface 318 of the bottom body part 304 to form a second pattern, e.g. a spiral. At each of two extremities of the recess 316 is a through hole 320*a*, 320*b*. A further through hole 322 is also provided in the bottom body part 304.

During assembly of the luminous display 300, the lower surface of the top body part 302 is fused together with the upper surface 308 of the intermediate body part 303 to form a first chamber. The lower surface of the intermediate body part 303 is then fused together with the upper surface of bottom body part 304, with the through hole 310*a* in communication with the through hole 320*a*, and the through hole 310*b* in communication with the through hole 322. Air in the chamber is then evacuated through one or both of the through holes 320*b*, 322. The chamber is then filled, again through one or both of the through holes 320*b*, 322, with an ionizable gas. An electrode 314 is then installed at and in communication with a respective through hole 320*b*, 322. The chamber formed between the recess 306 of the intermediate body part 303, the upper body part 302, the lower surface of the intermediate body part 303, and the recess 316 of the lower body part is thus sealed. When the electrodes 314 are energized to ionize the gas in the chamber, two coloured light discharges in the shape of two pre-defined patterns will be generated. The two pre-defined coloured patterns, i.e. one of a spider and one of a spiral, will be shown upon activation of the electrodes 314. The two coloured patterns are each of a different distance from the upper surface of the top body part 302, thus creating an overall three-dimensional pattern.

Figure 9A:
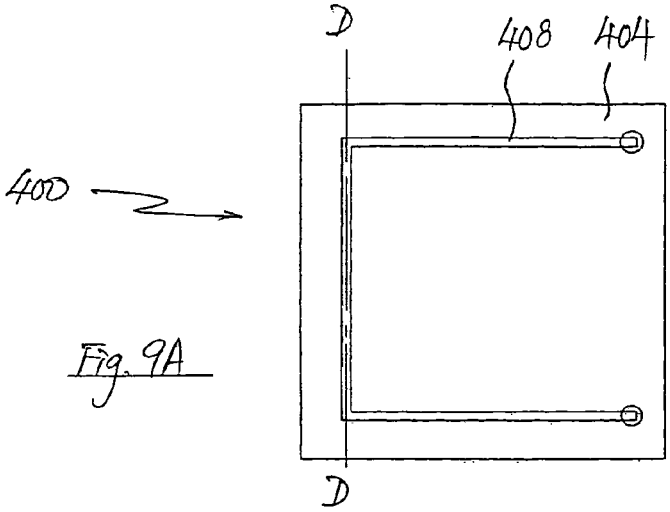
FIG. 9A is a top view of a bottom body part forming part of a luminous display according to a fourth embodiment of the present invention.
Figure 9B:
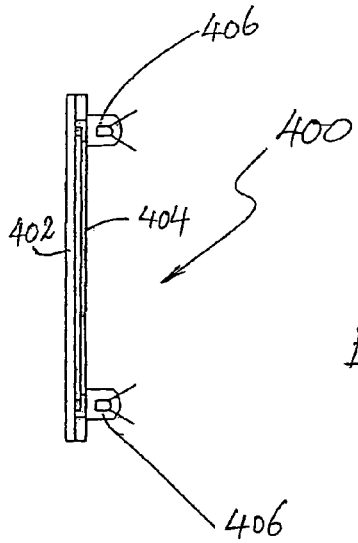
FIG. 9B is a sectional view of a luminous display according to the fourth embodiment of the present invention, taken along the line D-D of FIG. 9A.

In a fourth embodiment according to the invention, as shown in FIGS. 9A and 9B, a luminous display 400 includes a top body part 402 and a bottom body part 404. A continuous trough 408 in the form of three conjoining straight recesses is provided on the bottom body part 404. At each end of the trough 408 is installed a respective electrode 406, which are energizable to ionize the gas in the sealed chamber formed between the trough 408 and the top body part 402.

Figure 10A:
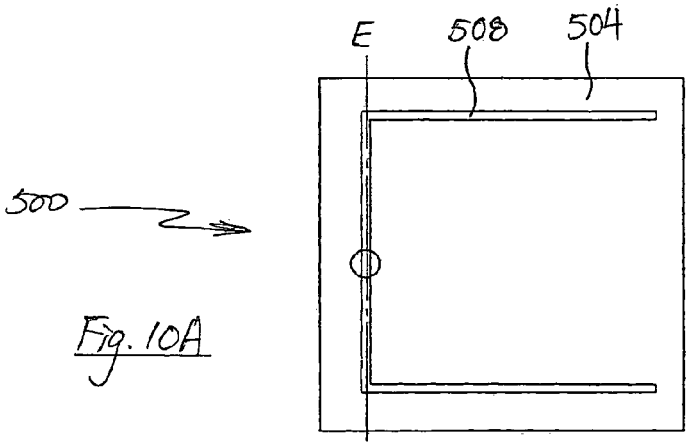
FIG. 10A is a top view of a bottom body part forming part of a luminous display according to a fifth embodiment of the present invention.
Figure 10B:
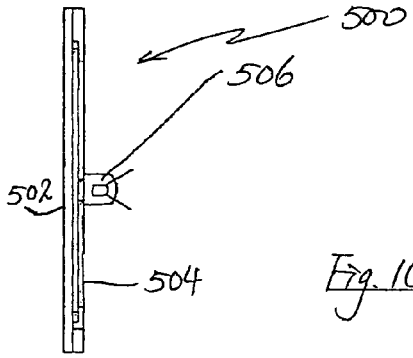
FIG. 10B is a sectional view of a luminous display according to the fifth embodiment of the present invention, taken along the line E-E of FIG. 10A.

In a fifth embodiment according to the invention, as shown in FIGS. 10A and 10B, a luminous display 500 includes a top body part 502 and a bottom body part 504. A main difference between the luminous display 500 and the luminous display 400 discussed above is that only one electrode 506 is provided, which is installed at a through hole at or adjacent to a mid-point between two extremities of a continuous trough 508 on the bottom body part 504.

Figure 11A:
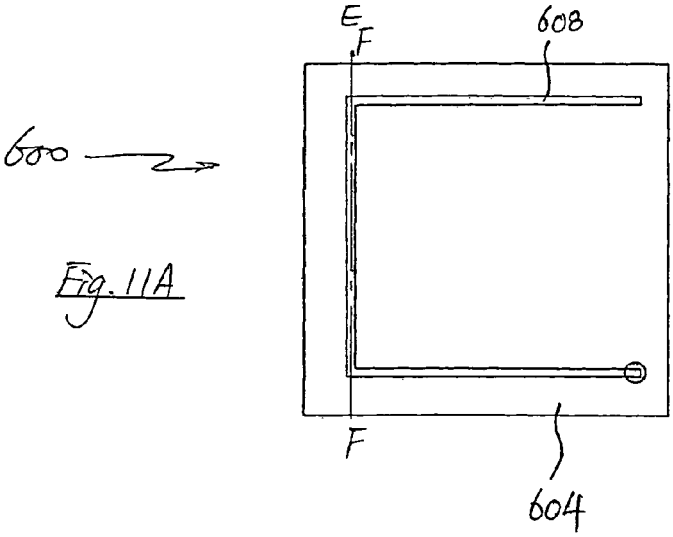
FIG. 11A is a top view of a bottom body part forming part of a luminous display according to a sixth embodiment of the present invention.
Figure 11B:
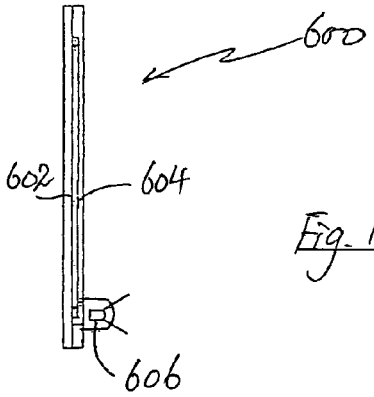
FIG. 11B is a sectional view of a luminous display according to the sixth embodiment of the present invention, taken along the line F-F of FIG. 11A.

In a sixth embodiment according to the invention, as shown in FIGS. 11A and 11B, a luminous display 600 includes a top body part 602 and a bottom body part 604. A main difference between the luminous display 600 and the luminous display 500 discussed above is that only one electrode 606 is installed, which is installed at a through hole at or adjacent to one of two extremities of a continuous trough 608 on the bottom body part 604.

It should be understood that the above only illustrates and describes examples whereby the present invention may be carried out, and that modifications and/or alterations may be made thereto without departing from the spirit of the invention. For example, the body parts may be curved in shape, e.g. undulating, or in a wave shape.

It should also be understood that certain features of the invention, which are, for clarity, described in the context of separate embodiments, may also be provided in combination in a single embodiment. Conversely, various features of the invention which are, for brevity, described in the context of a single embodiment, may also be provided or separately or in any suitable sub-combination.

What is claimed is:

1. A luminous display device comprising:

a non-opaque first member having a rear surface;

a second member having a front side, a rear side, and at least a first trough member extending along at least part of said front side of said second member to form at least a first pre-defined pattern;

wherein said rear surface of said first member is in fused sealing relationship with said front side of said second member to thereby form at least a first sealed discharge chamber between said first trough member and said first member;

an ionizable gas filling said chamber; and at least a first opening in one of said first and second members having a first end communicating with said first chamber and a second end communicating with an electrode, said electrode being energizable to ionize said gas in said first chamber to produce light discharge of said at least first pre-defined pattern.

2. A device according to claim 1 wherein said first trough member has two ends, each being in communication with a respective opening with which a respective electrode means is in communication.

3. A device according to claim 1 wherein said first trough member has two ends and only one first opening is provided in one of said first and second members having a first end communicating with said first chamber and a second end communicating with said electrode means.

4. A device according to claim 3 wherein said first opening is in communication with said first chamber at or adjacent to one said end of said first trough member.

5. A device according to claim 3 wherein said first opening is in communication with said first chamber at a point between said two ends of said first trough member.

6. A device according to claim 1 wherein said first opening is in said second member, and further including a third member with at least a second opening in communication with said first opening in said second member.

7. A device according to claim 6 wherein said third member includes a front side, a rear side, and at least a second trough member extending along at least part of said front side of said third member to form at least a second pre-defined pattern.

8. A device according to claim 7 wherein said front side of said third member is in fused sealing relationship with said rear side of said second member to thereby form at least a second sealed discharge chamber between said second trough member and said second member.

9. A device according to claim 1 further including phosphor coating on at least part of said first trough member.

10. A device according to claim 9 further including at least two phosphor coatings, each on at least a different part of said first trough member to thereby produce different colours upon ionization of said ionizable gas.

11. A device according to claim 1 further being adapted to produce light discharge of at least two pre-defined patterns, each being of a different distance from a front surface of said first member.

* * * * *